US012781326B2

(12) United States Patent
Seto et al.

(10) Patent No.: US 12,781,326 B2
(45) **Date of Patent: *Nov. 3, 2026**

(54) AUSTENITIC HEAT RESISTANT STEEL

(71) Applicant: NIPPON STEEL CORPORATION, Tokyo (JP)

(72) Inventors: Masahiro Seto, Tokyo (JP); Hiroyuki Hirata, Tokyo (JP); Mitsuru Yoshizawa, Tokyo (JP); Junichi Higuchi, Tokyo (JP); Takahiro Osuki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 723 days.

This patent is subject to a terminal disclaimer.

(21) Appl. No.: 17/996,543

(22) PCT Filed: Apr. 21, 2021

(86) PCT No.: PCT/JP2021/016188
§ 371 (c)(1),
(2) Date: Oct. 19, 2022

(87) PCT Pub. No.: WO2021/220912
PCT Pub. Date: Nov. 4, 2021

(65) Prior Publication Data

US 2023/0203629 A1 Jun. 29, 2023

(30) Foreign Application Priority Data

Apr. 30, 2020 (JP) ..... 2020-080197

(51) Int. Cl.
*C22C 38/48* (2006.01)
*C21D 1/84* (2006.01)
(Continued)

(52) U.S. Cl.
CPC ..... *C22C 38/48* (2013.01); *C21D 1/84* (2013.01); *C21D 6/004* (2013.01); *C21D 6/005* (2013.01);
(Continued)

(58) Field of Classification Search
CPC ..... C22C 38/48; C22C 38/04; C22C 38/02; C22C 33/04; C22C 38/42; C22C 38/50;
(Continued)

(56) References Cited

U.S. PATENT DOCUMENTS

2003/0231976 A1 12/2003 Iseda
2010/0034689 A1 2/2010 Hirata et al.
(Continued)

FOREIGN PATENT DOCUMENTS

CN 101633999 A 1/2010
JP 62133048 A 6/1987
(Continued)

OTHER PUBLICATIONS

NPL: on-line translation of JP-2014001436-A, Jan. 2014 (Year: 2014).*
(Continued)

*Primary Examiner* — Jie Yang
(74) *Attorney, Agent, or Firm* — Greer, Burns & Crain, Ltd.

(57) ABSTRACT

There is provided an austenitic heat resistant steel including a chemical composition that consists of, in mass %, C: 0.04 to 0.12%, Si: 0.01 to 0.30%, Mn: 0.50 to 1.50%, P: 0.001 to 0.040%, S: less than 0.0050%, Cu: 2.2 to 3.8%, Ni: 8.0 to 11.0%, Cr: 17.7 to 19.3%, Mo: 0.01 to 0.55%, Nb: 0.400 to 0.650%, B: 0.0010 to 0.0060%, N: 0.050 to 0.160%, Al: 0.025% or less, and O: 0.020% or less, with the balance: Fe and impurities and that satisfies $[0.170 \leq Nb - Nb_{ER} \leq 0.480]$.

20 Claims, 1 Drawing Sheet

(51) Int. Cl.

| | |
|---|---|
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C22C 33/04*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/50*** | (2006.01) |
| ***C22C 38/52*** | (2006.01) |
| ***C22C 38/54*** | (2006.01) |

(52) U.S. Cl.
CPC ..... *C21D 6/007* (2013.01); *C21D 6/008* (2013.01); *C21D 8/02* (2013.01); *C21D 8/0226* (2013.01); *C21D 8/0236* (2013.01); *C21D 8/0263* (2013.01); *C22C 33/04* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/50* (2013.01); *C22C 38/52* (2013.01); *C22C 38/54* (2013.01); *C21D 2211/001* (2013.01)

(58) Field of Classification Search
CPC .. C21D 2211/001; C21D 6/004; C21D 6/005; C21D 6/008
See application file for complete search history.

(56) References Cited

U.S. PATENT DOCUMENTS

| | | | | |
|---|---|---|---|---|
| 2013/0130058 | A1 | 5/2013 | Seda et al. | |
| 2018/0258505 | A1* | 9/2018 | Hirata | C22C 38/58 |
| 2023/0220508 | A1* | 7/2023 | Hirata | C22C 38/50 148/503 |

FOREIGN PATENT DOCUMENTS

| | | | | |
|---|---|---|---|---|
| JP | 2000256803 | A | * | 9/2000 |
| JP | 2003268503 | A | | 9/2003 |
| JP | 2014001436 | A | * | 1/2014 |
| JP | 2017014575 | A | | 1/2017 |
| JP | 2021049572 | A | | 4/2021 |
| WO | 2009044796 | A1 | | 4/2009 |
| WO | 2013073055 | A1 | | 5/2013 |

OTHER PUBLICATIONS

NPL: on-line translation of JP-2000256803-A, Sep. 2000 (Year: 2000).*

* cited by examiner

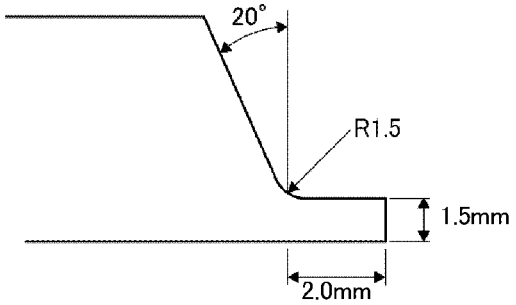
20°
R1.5
1.5mm
2.0mm

AUSTENITIC HEAT RESISTANT STEEL

CROSS-REFERENCES TO RELATED APPLICATIONS

This is a National Phase Application filed under 35 U.S.C. § 371, of International Application No. PCT/JP2021/016188, filed Apr. 21, 2021, which claimed priority to JP 2020-080197, filed Apr. 30, 2020, the contents of which are incorporated by reference.

TECHNICAL FIELD

The present invention relates to an austenitic heat resistant steel.

BACKGROUND ART

In a thermal power plant, operating conditions of a power generation boiler have been increasingly higher in terms of temperature and pressure so as to increase power generation efficiency from a viewpoint of reduction of environmental loads. Thus, materials of a superheater tube, a reheater tube, and the like used in the power generation boiler are required to have properties such as corrosion resistance, as well as excellent high temperature strength.

Hence, austenitic heat resisting alloys that are made to contain a large amount of Nb and N have been developed as materials having favorable high temperature strengths. For example, Patent Documents 1 to 6 each disclose an austenitic steel that is made to contain predetermined amounts of Nb and N to have an improved high temperature strength.

LIST OF PRIOR ART DOCUMENTS

Patent Document

Patent Document 1: JP62-133048A
Patent Document 2: JP2000-256803A
Patent Document 3: JP2003-268503A
Patent Document 4: WO 2009/044796
Patent Document 5: WO 2013/073055
Patent Document 6: JP2014-1436A

SUMMARY OF INVENTION

Technical Problem

When used at high temperature, the austenitic heat resistant steels disclosed in Patent Documents 1 to 6 may prone to variation in time taken to be ruptured at a certain level of stress, and there is room for improvement in terms of providing stable creep strength. Even when the stable creep strength is provided, containing of Nb makes cracking likely to occur in welding; thus the problem is that it is difficult to establish compatibility between stable creep strength and weld crack resistance.

An objective of the present invention is to solve the problem described above and to provide an austenitic heat resistant steel having a stable, favorable creep strength and an excellent weld crack resistance in its use at high temperature.

Solution to Problem

The present invention is made to solve the problem described above, and the gist of the present invention is the following austenitic heat resistant steel.

(1) An austenitic heat resistant steel including a chemical composition consisting of, in mass %:
C: 0.04 to 0.12%,
Si: 0.01 to 0.30%,
Mn: 0.50 to 1.50%,
P: 0.001 to 0.040%,
S: less than 0.0050%,
Cu: 2.2 to 3.8%,
Ni: 8.0 to 11.0%,
Cr: 17.7 to 19.3%,
Mo: 0.01 to 0.55%,
Nb: 0.400 to 0.650%,
B: 0.0010 to 0.0060%,
N: 0.050 to 0.160%,
Al: 0.025% or less,
O: 0.020% or less,
Co: 0 to 1.00%,
W: 0 to 1.00%,
Ti: 0 to 0.40%,
V: 0 to 0.40%,
Ta: 0 to 0.40%,
Sn: 0 to 0.0300%,
Ca: 0 to 0.0100%,
Mg: 0 to 0.0100%, and
REM: 0 to 0.0800%,
with the balance: Fe and impurities, wherein
a difference between a content of Nb and an amount of Nb analyzed as extraction residues satisfies Formula (i) shown below;

$$0.170 \leq Nb - Nb_{ER} \leq 0.480 \quad \text{(i)}$$

where Nb in the formula means the content of Nb (mass %) contained in the steel, and $Nb_{ER}$ means the amount of Nb (mass %) analyzed as extraction residues.

(2) The austenitic heat resistant steel according to the above (1), wherein Formula (ii) shown below is satisfied;

$$-2B + 0.185 \leq Nb - Nb_{ER} - 4B + 0.480 \quad \text{(ii)}$$

where symbols of elements in the formula mean the contents (mass %) of the elements contained in the steel, and $Nb_{ER}$ means the amount of Nb (mass %) analyzed as extraction residues.

(3) The austenitic heat resistant steel according to the above (1) or (2), wherein the chemical composition contains one or more elements selected from, in mass %:
Co: 0.01 to 1.00%,
W: 0.01 to 1.00%,
Ti: 0.01 to 0.40%,
V: 0.01 to 0.40%,
Ta: 0.01 to 0.40%,
Sn: 0.0002 to 0.0300%,
Ca: 0.0002 to 0.0100%,
Mg: 0.0002 to 0.0100%, and
REM: 0.0005 to 0.0800%.

(4) The austenitic heat resistant steel according to any one of the above (1) to (3), wherein Formula (iii) shown below is satisfied;

$$0.08P - 2B + 0.200 \leq Nb - Nb_{ER} - 0.4P - 4B + 0.450 \quad \text{(iii)}$$

where symbols of elements in the formula mean the contents (mass %) of the elements contained in the steel, and $Nb_{ER}$ means the amount of Nb (mass %) analyzed as extraction residues.

(5) The austenitic heat resistant steel according to any one of the above (1) to (4), wherein the chemical composition contains, in mass %, P: 0.010 to 0.040%.

(6) The austenitic heat resistant steel according to any one of the above (1) to (5), wherein the chemical composition contains, in mass %, P: 0.020 to 0.038%.

Advantageous Effects of Invention

According to the present invention, it is possible to provide an austenitic heat resistant steel having a stable, favorable creep strength and an excellent weld crack resistance in its use at high temperature.

BRIEF DESCRIPTION OF DRAWING

FIG. 1 is a diagram illustrating a bevel shape in EXAMPLE.

DESCRIPTION OF EMBODIMENTS

The present inventors conducted various studies for improving a high temperature strength, specifically a creep strength, and a weld crack resistance of an austenitic heat resistant steel containing Nb and N, and obtained the following findings (a) to (c).

(a) In a steel that can exert a high creep strength, a precipitation amount of carbo-nitride and nitride containing Nb was small before its use. In addition, in the use of the steel where the steel is exposed to high temperature, the carbo-nitride and nitride containing Nb precipitated in grains finely and densely and were present stably for a long time.

Further, in a case where excellent creep strength was exerted more stably, carbide containing Cr precipitated at grain boundaries finely in the use of the steel, and a large amount of B was dissolved in the carbide. It could be additionally confirmed that, in a case where a large amount of P was contained, the creep strength of the steel tends to be further increased.

In contrast, a steel having a poor creep strength included a large precipitation amount of carbo-nitride and nitride containing Nb before its use. Further, with use, the carbo-nitride and nitride containing Nb that precipitated finely in grains were small in amount and coarsened at an early stage.

For those reasons, in order to provide stable creep strength, it is desirable to dissolve Nb in a matrix adequately in advance and to cause precipitates containing Nb to precipitate at a usage stage. In addition, it is preferable to adjust an amount of Nb dissolved in a matrix (hereinafter, simply referred to as "dissolved Nb") depending on a content of B, which has the same effect as Nb.

(b) However, in a case where Nb and B were contained in a large amount, fine cracks occurred in some cases at crystal grain boundaries in a weld heat affected zone. This tendency was prominent in a case where P was contained in a large amount, and on a crack fracture surface, traces of local melting of grain boundaries were recognized, where concentration of Nb and/or P occurred. This was considered because these elements were caused to segregate in grain boundaries through weld thermal cycles, decreasing a melting point, by which the grain boundaries were locally melted.

When the dissolved Nb is compared with Nb present in a form of its precipitate, the dissolved Nb has a greater influence on weld crack susceptibility. The reason for this is that the dissolved Nb needs no time for being dissolved in a matrix through weld thermal cycles, and the Nb is likely to be concentrated at grain boundaries. As a result, weld cracks are likely to occur.

(c) In view of the above, it is found that the amount of dissolved Nb has a major influence on both properties of creep strength and weld crack resistance. It is therefore necessary to control the amount of dissolved Nb within its appropriate range so that compatibility between stable, high creep strength and favorable weld crack resistance are established. Likewise, since B and P have an influence on both creep strength and weld crack resistance, the amount of dissolved Nb is desirably adjusted depending on a content of B, and more desirably adjusted depending on contents of B and P.

The present invention is made based on the findings described above. Requirements of the present invention will be described below in detail.

1. Chemical Composition

Reasons for limiting a content of each element are as follows. In the following description, the symbol "%" for contents means "mass %".

C: 0.04 to 0.12%

C (carbon) stabilizes an austenitic structure and forms fine carbides, improving creep strength in high-temperature use of the austenitic heat resistant steel. A content of C is thus set to 0.04% or more. The content of C is preferably set to 0.06% or more, and more preferably set to 0.07% or more. However, if C is contained excessively, the effect of C is saturated, and carbides precipitate in a large quantity, decreasing creep ductility. The content of C is thus set to 0.12% or less. The content of C is preferably set to 0.10% or less, and more preferably set to 0.09% or less.

Si: 0.01 to 0.30%

Si (silicon) has a deoxidation effect in the process of production. Further, Si is an element useful in improving corrosion resistance and oxidation resistance at high temperature. A content of Si is thus set to 0.01% or more. The content of Si is preferably set to 0.03% or more, more preferably set to 0.05% or more, and still more preferably set to 0.10% or more. However, if Si is contained excessively, stability of an austenitic structure is decreased, leading to a decrease in toughness and creep strength. The content of Si is thus set to 0.30% or less. The content of Si is preferably set to 0.28% or less, more preferably set to 0.25% or less, and still more preferably set to 0.20% or less.

Mn: 0.50 to 1.50%

As with Si. Mn (manganese) has a deoxidation effect. In addition, Mn stabilizes an austenitic structure, contributing to improvement of creep strength. A content of Mn is thus set to 0.50% or more. The content of Mn is preferably set to 0.60% or more, and more preferably set to 0.70% or more. However, if Mn is contained excessively, the excessively contained Mn leads to embrittlement, further resulting in a decrease in creep ductility. The content of Mn is thus set to 1.50% or less. The content of Mn is preferably set to 1.30% or less, and more preferably set to 1.00% or less.

P: 0.001 to 0.040%

P (phosphorus) is an element contained in the steel as an impurity but has an effect of increasing creep strength. This would be because P has an influence on solid-solution strengthening or a precipitation condition. A content of P is thus set to 0.001% or more. The content of P is preferably set to 0.005% or more, more preferably set to 0.010% or more, and still more preferably set to 0.020/c or more.

However, if P is contained excessively, crack susceptibility of a weld heat affected zone in welding is increased. The content of P is thus set to 0.040% or less. The content of P is preferably set to 0.038% or less, and more preferably set to 0.035% or less.

S: less than 0.0050%

As with P, S (sulfur) is contained in the steel as an impurity and increases crack susceptibility of a weld heat affected zone in welding. A content of S is thus set to less than 0.0050%. The content of S is preferably set to less than 0.0020%, more preferably set to 0.0018% or less, and still more preferably set to 0.0015% or less. Note that the content of S is preferably reduced as much as possible, but an extreme reduction of the content of S leads to a rise in steel making costs. The content of S is thus preferably set to 0.0001% or more, and preferably 0.0002% or more.

Cu: 2.2 to 3.8%

Cu (copper) increases stability of an austenitic structure and finely precipitates in use of the austenitic heat resistant steel, contributing to improvement of creep strength. A content of Cu is thus set to 2.2% or more. The content of Cu is preferably set to 2.5% or more, and more preferably set to 2.7% or more. However, if Cu is contained excessively, hot workability is decreased. The content of Cu is thus set to 3.8% or less. The content of Cu is preferably set to 3.5% or less, and more preferably set to 3.3% or less.

Ni: 8.0 to 11.0%

Ni (nickel) stabilizes an austenitic structure, contributing to improvement of creep strength. A content of Ni is thus set to 8.0% or more. The content of Ni is preferably set to 8.2% or more, and more preferably set to 8.5% or more. However, since Ni is an expensive element, a high content of Ni leads to a rise in costs and also increases stability of austenite, decreasing weldability. The content of Ni is thus set to 11.0% or less. The content of Ni is preferably set to 10.8% or less, and more preferably set to 10.5% or less.

Cr: 17.7 to 19.3%

Cr (chromium) contributes to improvement of oxidation resistance and corrosion resistance at high temperature. Cr also forms its fine carbide, contributing to ensuring of creep strength. A content of Cr is thus set to 17.7% or more. The content of Cr is preferably set to 18.0% or more, and more preferably set to 18.2% or more. However, if Cr is contained excessively, stability of an austenitic structure is impaired, which causes production of sigma phases, decreasing creep strength. The content of Cr is thus set to 19.3% or less. The content of Cr is preferably set to 19.0% or less, and more preferably set to 18.8% or less.

Mo: 0.01 to 0.55%

Mo (molybdenum) is dissolved in a matrix, contributing to improvement of creep strength and tensile strength at high temperature. A content of Mo is thus set to 0.01% or more. The content of Mo is preferably set to 0.03% or more, and more preferably set to 0.05% or more. However, if Mo is contained excessively, the effect of Mo is saturated. Further, stability of an austenitic structure is impaired, rather resulting in a decrease in creep strength. In addition, since Mo is an expensive element, excessive containing of Mo leads to a rise in costs. The content of Mo is thus set to 0.55% or less. The content of Mo is preferably set to 0.53% or less, more preferably set to 0.50% or less, and still more preferably set to 0.40% or less.

Nb: 0.400 to 0.650%

Nb (niobium) precipitates in a form of its fine carbonitride and fine nitride, contributing to improvement of creep strength. A content of Nb is thus set to 0.400% or more. The content of Nb is preferably set to 0.420% or more, and more preferably set to 0.450% or more. However, if Nb is contained excessively, the excessively contained Nb leads to occurrence of weld cracks at a weld heat affected zone in welding. In addition, carbo-nitride and nitride of Nb precipitate in a large quantity, decreasing ductility of the material. The content of Nb is thus set to 0.650% or less. The content of Nb is preferably set to 0.630% or less, and more preferably set to 0.600% or less.

Note that the content of Nb means the amount of Nb contained in the austenitic heat resistant steel. That is, the content of Nb means a total of an amount of dissolved Nb and an amount of Nb present in a form of its precipitate. For the steel according to the present invention, an amount of dissolved Nb, namely, a difference between the content of Nb and an amount of Nb that is analyzed as extraction residues (an amount of Nb present in a form of its precipitate) is controlled as a predetermined range of the content of Nb. Further, it is preferable to set the amount of dissolved Nb within a predetermined range depending on the content of B or depending on the content of B and P.

B: 0.0010 to 0.0060%

B (boron) has an effect of finely dispersing grain boundary carbides, improving creep strength. A content of B is thus set to 0.0010% or more. The content of B is preferably set to 0.0020% or more, and more preferably set to 0.0030% or more. However, if B is contained excessively, crack susceptibility of a weld heat affected zone in welding is increased. The content of B is thus set to 0.0060% or less. The content of B is preferably set to 0.0055% or less, and more preferably set to 0.0050% or less.

N: 0.050 to 0.160%

N (nitrogen) stabilizes an austenitic structure and is dissolved or precipitates in a form of nitrides, contributing to improvement of creep strength. A content of N is thus set to 0.050% or more. The content of N is preferably set to 0.070% or more, and more preferably set to 0.090% or more. However, if N is contained excessively, fine nitrides precipitate in a large quantity, leading to a decrease in creep ductility and toughness. The content of N is thus set to 0.160% or less. The content of N is preferably set to 0.140% or less, and more preferably set to 0.120% or less.

Al: 0.025% or less

Al (aluminum) has a deoxidation effect. However, if Al is contained excessively, cleanliness of the steel deteriorates, and hot workability is decreased. A content of Al is thus set to 0.025% or less. The content of Al is preferably set to 0.023% or less, and more preferably set to 0.020% or less. On the other hand, an extreme reduction of Al leads to a rise in steel making costs and in addition fails to provide the effect. The content of Al is thus preferably set to 0.001% or more, and more preferably set to 0.002% or more.

O: 0.020% or less

O (oxygen) is contained in the steel as an impurity, and if O is contained excessively, hot workability is decreased. In addition, toughness and ductility are impaired. A content of O is thus set to 0.020% or less. The content of O is preferably set to 0.018% or less, and more preferably set to 0.015% or less. Note that no particular lower limit will be imposed on the content of O, but an extreme reduction of the content of O results in a rise in production costs. The content of O is thus preferably set to 0.001% or more, and more preferably set to 0.002% or more.

In the chemical composition, in addition to the elements described above, one or more elements selected from Co, W, Ti, V, Ta, Sn, Ca, Mg, and REM may be contained within their respective ranges described below. Reasons for limiting a content of each element will be described.

Co: 0 to 1.00%

As with Ni, Co (cobalt) has an effect of stabilizing an austenitic structure, contributing to improvement of creep strength. Thus, it may be contained as necessary. However, Co is a very expensive element, and if Co is contained excessively, production costs rise. A content of Co is thus set to 1.00% or less. The content of Co is preferably set to 0.90% or less, and more preferably set to 0.80% or less. On the other hand, to exert the effect, the content of Co is preferably set to 0.01% or more, and more preferably set to 0.03% or more.

W: 0 to 1.00%

W (tungsten) has an effect of improving creep strength at high temperature by being dissolved in a matrix or forming its fine intermetallic compound phases. Thus, it may be contained as necessary. However, even if W is contained excessively, the effect is saturated, and stability of an austenitic structure is impaired, rather resulting in a decrease in creep strength. Further, since W is an expensive element, excessive containing of W results in a rise in production costs. A content of W is thus set to 1.00% or less. The content of W is preferably set to 0.90% or less, and more preferably set to 0.80% or less. On the other hand, to exert the effect, the content of W is preferably set to 0.01% or more, and more preferably set to 0.03% or more.

Ti: 0 to 0.40%

Ti (titanium) combines with carbon and nitrogen to form its fine carbide and fine carbo-nitride, having an effect of improving creep strength at high temperature. Thus, it may be contained as necessary. However, if Ti is contained excessively, its precipitate precipitates in a large quantity, leading to a decrease in creep ductility and toughness. A content of Ti is thus set to 0.40% or less. The content of Ti is preferably set to 0.35% or less, and more preferably set to 0.30% or less. On the other hand, to exert the effect, the content of Ti is preferably set to 0.01% or more, and more preferably set to 0.02% or more.

V: 0 to 0.40%

As with Ti, V (vanadium) forms its fine carbide and fine carbo-nitride, having an effect of improving creep strength at high temperature. Thus, it may be contained as necessary. However, if V is contained excessively, its precipitate precipitates in a large quantity, leading to a decrease in creep ductility and toughness. A content of V is thus set to 0.40% or less. The content of V is preferably set to 0.35% or less, and more preferably set to 0.30% or less. On the other hand, to exert the effect, the content of V is preferably set to 0.01% or more, and more preferably set to 0.02% or more.

Ta: 0 to 0.40%

As with Ti and V, Ta (tantalum) forms its fine carbide and fine carbo-nitride, having an effect of improving creep strength at high temperature. Thus, it may be contained as necessary. However, if Ta is contained excessively, its precipitate precipitates in a large quantity, leading to a decrease in creep ductility and toughness. A content of Ta is thus set to 0.40% or less. The content of Ta is preferably set to 0.35% or less, and more preferably set to 0.30% or less. On the other hand, to exert the effect, the content of Ta is preferably set to 0.01% or more, and more preferably set to 0.02% or more.

Sn: 0 to 0.0300%

Sn (tin) has an effect of increasing weldability considerably. Thus, it may be contained as necessary. However, if Sn is contained excessively, crack susceptibility of a weld heat affected zone in welding is increased, and hot workability in the process of production is impaired. A content of Sn is thus set to 0.0300% or less. The content of Sn is preferably set to 0.0250% or less, and more preferably set to 0.0200% or less. On the other hand, to exert the effects, the content of Sn is preferably set to 0.0002% or more, and more preferably set to 0.0005% or more.

Ca: 0 to 0.0100%

Ca (calcium) has an effect of improving hot workability. Thus, it may be contained as necessary. However, if Ca is contained excessively, Ca combines with oxygen, which decreases cleanliness significantly, rather impairing hot workability. A content of Ca is thus set to 0.0100% or less. The content of Ca is preferably set to 0.0080/or less, and more preferably set to 0.0060% or less. On the other hand, to exert the effects, the content of Ca is preferably set to 0.0002% or more, and more preferably set to 0.0005% or more.

Mg: 0 to 0.0100%

As with Ca, Mg (magnesium) has an effect of improving hot workability. Thus, it may be contained as necessary. However, if Mg is contained excessively, Mg combines with oxygen, which decreases cleanliness significantly. As a result, hot workability is rather decreased. A content of Mg is thus set to 0.0100% or less. The content of Mg is preferably set to 0.0080% or less, and more preferably set to 0.0060% or less. On the other hand, to exert the effects, the content of Mg is preferably set to 0.0002% or more, and more preferably set to 0.0005% or more.

REM: 0 to 0.0800%

As with Ca and Mg, REM has an effect of improving hot workability in the process of production. Thus, it may be contained as necessary. However, if REM is contained excessively, REM combines with oxygen, which decreases cleanliness significantly. As a result, hot workability is rather decreased. A content of REM is thus set to 0.0800% or less. The content of REM is preferably set to 0.0600% or less, and more preferably set to 0.0500% or less. On the other hand, to exert the effect, the content of REM is preferably set to 0.0005% or more, and more preferably set to 0.0010% or more.

REM refers to Sc (scandium), Y (yttrium), and lanthanoids, 17 elements in total, and the content of REM means a total content of these elements. Industrially, REM is often added in a form of misch metal.

In the chemical composition according to the present invention, the balance is Fe and impurities. The term "impurities" herein means components that are mixed in steel in producing the steel industrially from raw materials such as ores and scraps and due to various factors in the producing process, and are allowed to be mixed in the steel within their respective ranges in which the impurities have no adverse effect on the present invention.

2. Amount of Dissolved Nb

Of Nb contained in the austenitic heat resistant steel, Nb that is present in a form of its precipitate before the use of the austenitic heat resistant steel contributes to improvement of creep strength, but the effect provided by the contribution is minor. In contrast, dissolved Nb precipitates finely and densely in grains in a form of its carbo-nitride or its nitride in use of the austenitic heat resistant steel at high temperature for a long time, greatly contributing to improvement of creep strength and stabilization of the improved creep strength.

To provide a high creep strength stably, it is effective to keep an adequate amount of dissolved Nb, that is, difference between an amount of Nb contained in the steel (the content of Nb) and an amount of Nb present in a form of its precipitate before use of the austenitic heat resistant steel (i.e., an amount of Nb analyzed as residues).

In contrast, Nb contained in the steel segregates at crystal grain boundaries in a weld heat affected zone through weld thermal cycles in welding. Nb lowers a solidus temperature of steel, and thus the crystal grain boundaries at which Nb segregates are locally melted, causing weld cracks. Compared with Nb present in the steel in a form of its precipitate, the dissolved Nb dissolved in a matrix has a great influence on weld crack susceptibility because the dissolved Nb does not take long to be dissolved in a matrix through weld thermal cycles.

In addition, B contained in the steel is dissolved in grain boundary carbides containing Cr and causes fine precipitation, increasing creep strength. As with Nb, B is an element that lowers a solidus temperature, and B segregates at grain boundaries in a weld heat affected zone during welding, increasing weld crack susceptibility. In view of the above, it is more preferable to adjust the amount of dissolved Nb within its appropriate range and to adjust the amount of dissolved Nb depending on the content of B.

In addition, As with B and Nb, P contained in the steel is also an element that lowers a solidus temperature, and P segregates at grain boundaries in a weld heat affected zone during welding, increasing weld crack susceptibility. For that reason, it is still more preferable to adjust the amount of Nb within its appropriate range and to adjust the amount of dissolved Nb depending on the content of B as well as the content of P.

Specifically, in the steel according to the present invention, a difference between the content of Nb and an amount of Nb analyzed as extraction residues, the difference being equivalent to the amount of dissolved Nb, is needed to satisfy Formula (i) shown below.

$$0.170 \leq Nb - Nb_{ER} \leq 0.480 \quad \text{(i)}$$

where Nb in the formula means the content of Nb (mass %) contained in the steel, and $Nb_{ER}$ means the amount of Nb (mass %) analyzed as extraction residues.

If the amount of dissolved Nb, which is the middle value of Formula (i), is less than 0.170%, a state where carbo-nitride and nitride containing Nb precipitate is brought about before the austenitic heat resistant steel is exposed to a usage environment, and as a result, the carbo-nitride and nitride containing Nb do not precipitate finely in grains at high-temperature use of the austenitic heat resistant steel. In addition, these precipitates coarsen at an early stage. This results in a failure to improve creep strength. The amount of dissolved Nb is therefore set to 0.170% or more. The amount of dissolved Nb is preferably set to 0.180% or more, more preferably set to 0.185% or more, and still more preferably set to 0.190% or more.

However, if the amount of dissolved Nb is more than 0.480%, weld crack susceptibility of a weld heat affected zone is further increased in welding. The amount of dissolved Nb is therefore set to 0.480% or less. The amount of dissolved Nb is preferably set to 0.4600 or less, more preferably set to 0.440% or less, and still more preferably set to 0.400% or less.

Further, as described above, it is preferable to adjust the amount of dissolved Nb, with consideration given to the effect of B of increasing creep strength by being dissolved in the Cr carbide and finely precipitating at grain boundaries. Specifically, it is preferable that the amount of dissolved Nb satisfy Formula (ii) shown below.

$$-2B + 0.185 \leq Nb - Nb_{ER} \leq -4B + 0.480 \quad \text{(ii)}$$

where symbols of elements in the formula mean the contents (mass %) of the elements contained in the steel, and $Nb_{ER}$ means the amount of Nb (mass %) analyzed as extraction residues.

This is because when the amount of dissolved Nb is not less than the left side value of Formula (ii), after the amount of dissolved Nb is ensured, the Cr carbide in which B is dissolved finely precipitates at grain boundaries, further improving creep strength. At the same time, this is because when the amount of dissolved Nb is not more than the right side value of Formula (ii), weld crack resistance can be improved.

In addition, as described above, while it is considered that P influences solid-solution strengthening and a precipitation condition, improving creep strength, P lowers a solidus temperature and segregates at grain boundaries in a weld heat affected zone during welding, increasing weld crack susceptibility, as with B and Nb. For that reason, it is still more preferable to adjust the amount of dissolved Nb depending on the content of B as well as the content of P. Specifically, it is preferable that the amount of dissolved Nb satisfy Formula (iii) shown below.

$$0.08P - 2B + 0.200 \leq Nb - Nb_{ER} \leq -0.4P - 4B + 0.450 \quad \text{(iii)}$$

where symbols of elements in the formula mean the contents (mass %) of the elements contained in the steel, and $Nb_{ER}$ means the amount of Nb (mass %) analyzed as extraction residues.

This is because when the amount of dissolved Nb is not less than the left side value of Formula (iii), after the amount of dissolved Nb is ensured, the Cr carbide in which B is dissolved finely precipitates at grain boundaries, and it is possible to favorably control the solid-solution strengthening and the precipitation condition brought by P. This is considered to result in further improvement of creep strength. At the same time, this is because when the amount of dissolved Nb is not more than the right side value of Formula (iii), more stable weld crack resistance can be ensured.

Note that the amount of Nb analyzed as extraction residues in the formula above can be measured by the following procedure. From the steel, a test specimen having a predetermined size is taken. This test specimen is subjected to anodic dissolution by a constant-current electrolysis with a current density of 20 mA/cm$^2$ in which 10 vol. % acetylacetone-1 mass % tetramethylammonium chloride methanol solution is used as its electrolyte, by which carbo-nitrides and nitrides are extracted as residues. The extracted residues are subjected to acid decomposition and then inductively coupled plasma (ICP) optical emission spectrometry, by which a mass of Nb in the residues is measured. By dividing the mass of Nb in the residues by a dissolved mass of the test material, an amount of Nb present in a form of its carbo-nitride and nitride is determined. The determined amount of Nb is the amount of Nb analyzed as the extraction residues.

3. Production Method

A preferable method for producing the steel according to the present invention will be described. The steel according to the present invention exerts its advantageous effects irrespective of its production method as long as the steel has the configuration described above; nonetheless, the steel can be produced stably by a production method described below, for example.

A steel having the chemical composition described above is preferably machined and formed into a final shape, that is, a product shape. A method for the machining and formation is not limited to a particular method; the method may be casting for the formation using a mold or may be plastic working. In a case where the plastic working is employed for the formation, hot rolling, hot forging, cold rolling, cold forging, cold drawing or the like is conceivable for example, and a working temperature may be within any temperature range such as a hot temperature range, a cold temperature range, and a warm temperature range. Note that heat treatment and pickling may be performed in a forming step as necessary.

The product shape provided by the machining and formation is not limited to a particular shape, either. Examples of a conceivable product shape include a plate shape, a tubular shape, a bar shape, a wire shape, an H shape, and an I shape, and in addition, a peculiar shape provided by using a mold.

Subsequently, solution heat treatment is preferably performed. In the solution heat treatment, it is preferable to perform the heat treatment with its heat treatment temperature set within a temperature range of 1100 to 1230° C. and its soaking time set to 1 to 12 minutes.

If the heat treatment temperature is less than 1100° C., precipitate containing Nb formed before the forming step is not dissolved in a matrix sufficiently, failing to ensure a sufficient amount of dissolved Nb. In addition, residual strain induced in the forming step cannot be removed. It is considered that this consequently causes the carbo-nitride or nitride containing Nb not to precipitate finely and densely for a long time in a usage environment where the austenitic heat resistant steel is exposed to high temperature, failing to provide stable creep strength. The heat treatment temperature of the solution heat treatment is therefore preferably set to 1100° C. or more. The heat treatment temperature is more preferably set to 1120° C. or more.

On the other hand, if the heat treatment temperature is more than 1230° C., although the amount of dissolved Nb is sufficient, weld crack susceptibility is increased at a weld heat affected zone due to grain-boundary segregation of Nb as well as coarsening of grains. The heat treatment temperature is therefore preferably set to 1230° C. or less. The heat treatment temperature is more preferably set to 1200° C. or less.

Likewise, if the soaking time of the solution heat treatment is less than 1 minute, precipitate containing Nb formed before the forming step is not dissolved in a matrix sufficiently, failing to ensure a sufficient amount of dissolved Nb. In addition, residual strain induced in the forming step cannot be removed. As a result, a desired creep strength is less likely to be provided. The soaking time is therefore preferably set to 1 minute or more. The soaking time is more preferably set to 2 minutes or more.

On the other hand, if the soaking time is more than 12 minutes, although the amount of dissolved Nb is sufficient, weld crack susceptibility is increased at a weld heat affected zone due to grain-boundary segregation of Nb as well as coarsening of grains. The soaking time is therefore preferably set to 12 minutes or less. The soaking time is more preferably set to 10 minutes or less. Note that the heat treatment is performed in a heat treatment furnace, and an atmosphere for the heat treatment is only required to conform to a conventional method. For example, an air atmosphere used in a normal heat treatment or an atmosphere for bright heat treatment is conceivable.

After heating is performed at the heat treatment temperature and for the soaking time within their respective ranges, it is preferable to perform cooling. A method for the cooling is not limited to a particular method; however, a cooling rate for the temperature range of 1000 to 600° C. is preferably set to 0.4° C./s or more, and more preferably set to 1.0° C./s or more. A preferable method for the cooling is forced cooling in which the cooling is forcibly performed by spraying coolant such as water and air on the steel. Examples of the forced cooling include water cooling and forced air cooling. When the forced cooling is performed, it is preferable to perform control in such a manner that a difference between the heat treatment temperature and a temperature of the steel at a time of starting the forced cooling (hereinafter, simply referred to as "cooling start temperature difference") is 40° C. or less.

The cooling start temperature difference is preferably 0° C. However, it is difficult for a normal equipment system, for example, in the process of production using an actual machine, to bring the cooling start temperature difference to 0° C. The cooling start temperature difference is therefore more preferably 1° C. or more, and still more preferably is 2° C. or more. Note that the heat treatment temperature means a temperature of the steel at a time of performing the heat treatment, and the temperature of the steel means a surface temperature of the steel.

Further, the cooling is preferably performed until the temperature of the steel decreases to 300° C. or less. Satisfying these production conditions enables the amount of dissolved Nb to be adjusted within its appropriate range.

The present invention will be described below more specifically with reference to examples, but the present invention is not limited to these examples.

EXAMPLE

Steel types A to T having chemical compositions shown in Table 1 were melted and cast into ingots, and the ingots were subjected to hot forging to have a thickness of 25 mm, subjected to hot rolling to have a thickness of 18 mm, and then subjected to cold rolling to be formed to have a thickness of 12 mm.

[Table 1]

TABLE 1

| Steel | Chemical composition (mass %, Balance: Fe and Impurities) | | | | | | | | | | | |
|---|---|---|---|---|---|---|---|---|---|---|---|---|
| type | C | Si | Mn | P | S | Cu | Ni | Cr | Mo | Nb | B | N |
| A | 0.07 | 0.25 | 0.75 | 0.028 | 0.0012 | 3.2 | 9.0 | 18.7 | 0.08 | 0.476 | 0.0030 | 0.095 |
| B | 0.07 | 0.22 | 0.80 | 0.030 | 0.0011 | 2.9 | 9.4 | 18.3 | 0.12 | 0.510 | 0.0035 | 0.110 |
| C | 0.09 | 0.05 | 0.71 | 0.025 | 0.0005 | 3.3 | 8.8 | 18.5 | 0.23 | 0.628 | 0.0055 | 0.072 |
| D | 0.06 | 0.14 | 0.60 | 0.022 | 0.0015 | 3.5 | 8.5 | 18.2 | 0.53 | 0.424 | 0.0020 | 0.105 |
| E | 0.06 | 0.20 | 0.98 | 0.026 | 0.0008 | 2.7 | 10.4 | 19.0 | 0.06 | 0.586 | 0.0049 | 0.090 |
| F | 0.10 | 0.17 | 0.70 | 0.035 | 0.0014 | 2.5 | 8.3 | 18.5 | 0.50 | 0.450 | 0.0015 | 0.120 |
| G | 0.08 | 0.08 | 0.95 | 0.020 | 0.0002 | 3.0 | 8.8 | 18.8 | 0.44 | 0.636 | 0.0059 | 0.061 |
| H | 0.08 | 0.12 | 1.03 | 0.038 | 0.0015 | 2.4 | 9.3 | 18.3 | 0.32 | 0.408 | 0.0013 | 0.148 |
| I | 0.05 | 0.25 | 0.80 | 0.017 | 0.0011 | 2.3 | 8.4 | 19.1 | 0.05 | 0.420 | 0.0019 | 0.071 |
| J | 0.06 | 0.24 | 0.88 | 0.011 | 0.0012 | 2.2 | 8.6 | 18.9 | 0.03 | 0.418 | 0.0020 | 0.069 |
| K | 0.05 | 0.28 | 0.57 | 0.022 | 0.0006 | 2.4 | 8.3 | 19.2 | 0.49 | 0.388 | 0.0021 | 0.070 |
| L | 0.05 | 0.20 | 1.20 | 0.039 | 0.0019 | 3.6 | 10.7 | 18.3 | 0.08 | 0.662 | 0.0053 | 0.098 |
| M | 0.07 | 0.19 | 0.83 | 0.038 | 0.0010 | 3.3 | 10.6 | 18.4 | 0.10 | 0.523 | 0.0062 | 0.112 |

TABLE 1-continued

| | | | | | | | | | | | | |
|---|---|---|---|---|---|---|---|---|---|---|---|---|
| N | 0.09 | 0.23 | 1.01 | 0.014 | 0.0011 | 2.9 | 9.2 | 18.2 | 0.06 | 0.412 | 0.0036 | 0.113 |
| O | 0.08 | 0.20 | 0.95 | 0.032 | 0.0015 | 3.2 | 9.2 | 18.7 | 0.05 | 0.460 | 0.0055 | 0.110 |
| P | 0.05 | 0.27 | 0.90 | 0.0004 | 0.0011 | 2.4 | 8.3 | 18.1 | 0.04 | 0.412 | 0.0018 | 0.063 |
| Q | 0.09 | 0.19 | 0.78 | 0.045 | 0.0019 | 3.2 | 10.5 | 18.8 | 0.06 | 0.635 | 0.0058 | 0.095 |
| R | 0.08 | 0.12 | 0.66 | 0.038 | 0.0015 | 3.2 | 18.2 | 19.0 | 0.15 | 0.420 | 0.0032 | 0.101 |
| S | 0.06 | 0.15 | 0.92 | 0.036 | 0.0018 | 3.0 | 10.8 | 22.0 | 0.22 | 0.445 | 0.0041 | 0.090 |
| T | 0.04 | 0.23 | 0.57 | 0.012 | 0.0010 | 2.2 | 8.3 | 18.2 | — | 0.410 | 0.0020 | 0.065 |
| U | 0.10 | 0.15 | 0.80 | 0.005 | 0.0010 | 3.4 | 8.4 | 18.8 | 0.33 | 0.552 | 0.0038 | 0.101 |

| Steel | Chemical composition (mass %, Balance: Fe and Impurities) | | | | | | | | | | |
|---|---|---|---|---|---|---|---|---|---|---|---|
| type | Al | O | Co | W | Ti | V | Ta | Sn | Ca | Mg | REM |
| A | 0.011 | 0.007 | — | — | — | — | — | — | — | — | — |
| B | 0.009 | 0.008 | 0.05 | — | 0.03 | — | — | — | — | — | 0.0030 |
| C | 0.012 | 0.008 | — | — | — | — | — | — | — | — | — |
| D | 0.012 | 0.010 | — | 0.32 | — | — | — | 0.0020 | 0.0018 | — | — |
| E | 0.008 | 0.009 | — | — | — | 0.02 | 0.03 | — | — | 0.0012 | — |
| F | 0.009 | 0.011 | — | — | — | — | — | — | — | — | — |
| G | 0.010 | 0.008 | — | — | — | — | — | — | — | — | — |
| H | 0.011 | 0.010 | — | — | — | — | — | — | — | — | — |
| I | 0.012 | 0.009 | — | — | — | — | — | — | — | — | — |
| J | 0.010 | 0.010 | — | — | — | — | — | — | — | — | — |
| K | 0.009 | 0.008 | — | — | — | — | — | — | — | — | — |
| L | 0.010 | 0.008 | — | — | — | — | — | 0.022 | — | — | — |
| M | 0.009 | 0.010 | — | — | — | — | — | — | — | — | — |
| N | 0.014 | 0.010 | — | — | — | — | — | — | — | — | — |
| O | 0.012 | 0.008 | — | — | — | — | — | — | — | — | — |
| P | 0.014 | 0.008 | — | — | — | — | — | — | — | — | — |
| Q | 0.011 | 0.010 | — | — | — | — | — | — | — | — | — |
| R | 0.012 | 0.011 | — | — | — | — | — | 0.018 | — | — | — |
| S | 0.012 | 0.009 | — | — | — | — | — | — | — | — | — |
| T | 0.010 | 0.008 | — | — | — | — | — | — | — | — | — |
| U | 0.010 | 0.007 | — | — | — | — | — | — | — | — | — |

Underline value: indicating that the value fell out of the range in the chemical composition specified in the present invention.

Thereafter, from the starting materials subjected to the cold rolling, sheet materials that were 12 mm thick×100 mm wide×100 mm long were fabricated by machining. The fabricated sheet materials were subjected to the solution heat treatment under conditions shown in Tables 2 and 3. Note that, in the solution heat treatment, water cooling was performed after heating so that the cooling start temperature difference fell within ranges shown in Tables 2 and 3. The water cooling was performed until temperatures of the steels reached 300° C. or less, so that steels including an austenitic structure were given, which were used as test materials. Note that examples where their cooling start temperature differences are 0° C. indicate that the cooling was performed immediately after the solution heat treatment. Here, in every method for the cooling, its cooling rate was 0.4° C./s or more in the temperature range of 1000 to 600° C.

The resultant test materials were each subjected to the constant-current electrolysis, by which the amount of Nb analyzed as extraction residues was measured. Specifically, from each test material, an 8 mm square test specimen having a length of 40 mm was taken, and the test specimen was subjected to anodic dissolution by a constant-current electrolysis with a current density of 20 mA/cm$^2$ in which 10 vol. % acetylacetone-1 mass % tetramethylammonium chloride methanol solution was used as its electrolyte, by which carbo-nitrides and nitrides were extracted as residues. The extracted residues were subjected to acid decomposition and then inductively coupled plasma (ICP) optical emission spectrometry, by which a mass of Nb in the residues is measured, and the measured mass of Nb in the residues was divided by a dissolved mass of the test material, by which an amount of Nb present in a form of its carbo-nitride and nitride was determined.

In addition, from the resultant test materials, round-bar creep test specimens were taken, which were subjected to a creep rupture test. The creep rupture test was conducted under conditions of 650° C.×216 MPa with a target rupture time of a base metal set to 1000 hours, and evaluation in the creep rupture test was such that a test specimen with the rupture time that exceeded the target rupture time or satisfied 95% or more of the target rupture time was rated as "excellent", a test specimen with the rupture time that was 90% or more to less than 95% of the target rupture time was rated as "acceptable", the test specimen being rated as "excellent" or "acceptable" was regarded as "good", and a test specimen with the rupture time that was less than 90% of the target rupture time was rated as "failed".

In addition, some of the examples were also subjected to a creep rupture test under conditions of 700° C.×147 MPa, and evaluation in the creep rupture test was such that a test specimen with the rupture time that was more than 2000 hours, which was a target rupture time of the creep rupture test, or satisfied 95% or more of the target rupture time was rated as "excellent", a test specimen with the rupture time that was 90% or more to less than 95% of the target rupture time was rated as "acceptable", the test specimen being rated as "excellent" or "acceptable" was regarded as "good", and a test specimen with the rupture time that was less than 90% of the target rupture time was rated as "failed".

The resultant test materials were machined to be thinned to have a thickness of 8 mm and then subjected to beveling illustrated in FIG. 1 at their end faces in their longitudinal direction. Grooved faces of each test material were butted against each other, and the test specimen was subjected to restraint-weld at its four sides on a commercial steel plate equivalent to SM400B specified in JIS G 3106:2008 (20 mm thick, 150 mm wide, and 150 mm long) with a covered electrode specified in A5.11-2005 ENiCrFe-3 and then subjected to multi-pass weld in the groove by automatic gas tungsten arc welding.

For the welding, AWS A5.14-2009 ERNiCr-3 having an outer diameter of 1.2 mm was used as a filler material, and its heat input was set to about 9 to 12 kJ/cm. Further. Ar was used as shielding gas and back shielding gas for the welding, with its flow rate set to 10 L/min. In addition, in some of the examples, their resultant test materials were not thinned but left having a thickness of 12 mm, and subjected to the beveling, the restraint-weld, and the multi-pass weld in the manner described above.

From each of the resultant welded joints having a wall thickness of 8 mm or 12 mm, five cross sections were made to appear, mirror-polished, etched, and then subjected to microscopic examination under an optical microscope, by which whether any crack was present or not in a weldment was examined for each wall thicknesses welded joint. A welded joint for which no crack was observed on its five welded joint samples of each wall thickness was rated as "excellent", a welded joint for which a crack was observed on one of the samples was rated as "acceptable", the welded joint being rated as "excellent" or "acceptable" was regarded as "good", and a welded joint for which cracks were observed on two or more of the samples was rated as "failed". The results are shown in Table 2 and Table 3 below.

TABLE 2

| Test piece | Steel type | Solution heat treatment: Temperature T (° C.) | Solution heat treatment: Soaking time (min) | Solution heat treatment: Cooling start temperature difference (° C.) | Content of P (mass %) | Content of Nb (mass %) | Content of B (mass %) | $Nb_{ER}$ (mass %) | Amount of dissolved Nb Middle value of Formula (i) (mass %) | Left side value of Formula (ii) |
|---|---|---|---|---|---|---|---|---|---|---|
| A1 | A | 1150 | 2 | 0 | 0.028 | 0.476 | 0.0030 | 0.246 | 0.230 | 0.179 |
| A2 | A | 1200 | 2 | 0 | 0.028 | 0.476 | 0.0030 | 0.156 | 0.320 | 0.179 |
| A3 | A | 1100 | 2 | 0 | 0.028 | 0.476 | 0.0030 | 0.303 | 0.173 **,*** | 0.179 |
| A4 | A | 1230 | 2 | 0 | 0.028 | 0.476 | 0.0030 | 0.110 | 0.366 | 0.179 |
| A5 | A | 1150 | 2 | 10 | 0.028 | 0.476 | 0.0030 | 0.262 | 0.214 | 0.179 |
| A6 | A | 1150 | 2 | 20 | 0.028 | 0.476 | 0.0030 | 0.270 | 0.206 | 0.179 |
| A7 | A | 1150 | 2 | 30 | 0.028 | 0.476 | 0.0030 | 0.279 | 0.197 | 0.179 |
| A8 | A | 1150 | 2 | 40 | 0.028 | 0.476 | 0.0030 | 0.289 | 0.187 *** | 0.179 |
| A9 | A | 1150 | 2 | 50 | 0.028 | 0.476 | 0.0030 | 0.301 | 0.175 **,*** | 0.179 |
| B1 | B | 1150 | 2 | 0 | 0.030 | 0.510 | 0.0035 | 0.250 | 0.260 | 0.178 |
| B2 | B | 1200 | 2 | 0 | 0.030 | 0.510 | 0.0035 | 0.159 | 0.351 | 0.178 |
| C1 | C | 1150 | 2 | 0 | 0.025 | 0.628 | 0.0055 | 0.275 | 0.353 | 0.174 |
| C2 | C | 1200 | 2 | 0 | 0.025 | 0.628 | 0.0055 | 0.172 | 0.456 *** | 0.174 |
| D1 | D | 1150 | 2 | 0 | 0.022 | 0.424 | 0.0020 | 0.239 | 0.185 *** | 0.181 |
| D2 | D | 1200 | 2 | 0 | 0.022 | 0.424 | 0.0020 | 0.152 | 0.272 | 0.181 |
| E1 | E | 1150 | 2 | 0 | 0.026 | 0.586 | 0.0049 | 0.261 | 0.325 | 0.175 |
| E2 | E | 1200 | 2 | 0 | 0.026 | 0.586 | 0.0049 | 0.162 | 0.424 *** | 0.175 |
| F1 | F | 1150 | 2 | 0 | 0.035 | 0.450 | 0.0015 | 0.241 | 0.209 | 0.182 |
| F2 | F | 1200 | 2 | 0 | 0.035 | 0.450 | 0.0015 | 0.153 | 0.297 | 0.182 |
| G1 | G | 1150 | 2 | 0 | 0.020 | 0.636 | 0.0059 | 0.277 | 0.359 | 0.173 |
| G2 | G | 1200 | 2 | 0 | 0.020 | 0.636 | 0.0059 | 0.177 | 0.459 **,*** | 0.173 |
| G3 | G | 1100 | 2 | 0 | 0.020 | 0.636 | 0.0059 | 0.344 | 0.292 | 0.173 |
| G4 | G | 1250 | 2 | 0 | 0.020 | 0.636 | 0.0059 | 0.118 | 0.518 *,**,*** | 0.173 |

| Test piece | Right side value of Formula (ii) | Left side value of Formula (iii) | Right side value of Formula (iii) | Creep rupture test: 650° C. 216 MPa | Creep rupture test: 700° C. 147 MPa | Restraint weld cracking test: 8 mm sample | Restraint weld cracking test: 12 mm sample | |
|---|---|---|---|---|---|---|---|---|
| A1 | 0.468 | 0.196 | 0.427 | Good (excellent) | — | Good (excellent) | — | Inventive example |
| A2 | 0.468 | 0.196 | 0.427 | Good (excellent) | — | Good (excellent) | Good (excellent) | |
| A3 | 0.468 | 0.196 | 0.427 | Good (acceptable) | Good (acceptable) | Good (excellent) | — | |
| A4 | 0.468 | 0.196 | 0.427 | Good (excellent) | — | Good (excellent) | — | |
| A5 | 0.468 | 0.196 | 0.427 | Good (excellent) | — | Good (excellent) | — | |
| A6 | 0.468 | 0.196 | 0.427 | Good (excellent) | — | Good (excellent) | — | |
| A7 | 0.468 | 0.196 | 0.427 | Good (excellent) | Good (excellent) | Good (excellent) | — | |
| A8 | 0.468 | 0.196 | 0.427 | Good (excellent) | Good (acceptable) | Good (excellent) | — | |
| A9 | 0.468 | 0.196 | 0.427 | Good (acceptable) | Good (acceptable) | Good (excellent) | — | |
| B1 | 0.466 | 0.195 | 0.424 | Good (excellent) | — | Good (excellent) | — | |
| B2 | 0.466 | 0.195 | 0.424 | Good (excellent) | — | Good (excellent) | — | |
| C1 | 0.458 | 0.191 | 0.418 | Good (excellent) | Good (excellent) | Good (excellent) | Good (excellent) | |
| C2 | 0.458 | 0.191 | 0.418 | Good (excellent) | — | Good (excellent) | Good (acceptable) | |
| D1 | 0.472 | 0.198 | 0.433 | Good (excellent) | Good (acceptable) | Good (excellent) | — | |
| D2 | 0.472 | 0.198 | 0.433 | Good (excellent) | Good (excellent) | Good (excellent) | Good (excellent) | |
| E1 | 0.460 | 0.192 | 0.420 | Good (excellent) | — | Good (excellent) | — | |
| E2 | 0.460 | 0.192 | 0.420 | Good (excellent) | — | Good (excellent) | Good (acceptable) | |
| F1 | 0.474 | 0.200 | 0.430 | Good (excellent) | — | Good (excellent) | — | |
| F2 | 0.474 | 0.200 | 0.430 | Good (excellent) | Good (excellent) | Good (excellent) | Good (excellent) | |
| G1 | 0.456 | 0.190 | 0.418 | Good (excellent) | — | Good (excellent) | — | |

TABLE 2-continued

| | | | | | | | | |
|---|---|---|---|---|---|---|---|---|
| G2 | 0.456 | 0.190 | 0.418 | Good (excellent) | — | Good (acceptable) | Good (acceptable) | |
| G3 | 0.456 | 0.190 | 0.418 | Good (excellent) | — | Good (excellent) | — | |
| G4 | 0.456 | 0.190 | 0.418 | Good (excellent) | — | Failed | Failed | Comparative example |

The mark "*" indicates that a value with the mark fell out of the range specified in the present invention.
The mark "†" indicates that content of P fell out of its preferable range.
The mark "††" indicates that content of P fell out of its more preferable range.
The mark "**" indicates that a value with the mark fell out of the range of Formula (ii)
The mark "***" indicates that a value with the mark fell out of the range of Formula (iii).
The underline indicates that an underlined value fell out of its preferable production condition or out of its targeted property value according to the present invention.

$0.170 \leq Nb - Nb_{ER} \leq 0.480$ . . . (i)

$-2B + 0.185 \leq Nb - Nb_{ER} \leq -4B + 0.480$ . . . (ii)

$0.08P - 2B + 0.200 \leq Nb - Nb_{ER} \leq -0.4P - 4B + 0.450$ . . . (iii)

TABLE 3

| Test piece | Steel type | Solution heat treatment: Temperature T (° C.) | Solution heat treatment: Soaking time (min) | Solution heat treatment: Cooling start temperature difference (° C.) | Content of P (mass %) | Content of Nb (mass %) | Content of B (mass %) | $Nb_{ER}$ (mass %) | Amount of dissolved Nb Middle value of Formula (i) (mass %) | Left side value of Formula (ii) |
|---|---|---|---|---|---|---|---|---|---|---|
| H1 | H | 1150 | 2 | 0 | 0.038 | 0.408 | 0.0013 | 0.228 | 0.180 **,*** | 0.182 |
| H2 | H | 1200 | 2 | 0 | 0.038 | 0.408 | 0.0013 | 0.148 | 0.260 | 0.182 |
| H3 | H | 1080 | 2 | 0 | 0.038 | 0.408 | 0.0013 | 0.272 | 0.136 *,**,*** | 0.182 |
| H4 | H | 1230 | 2 | 0 | 0.038 | 0.408 | 0.0013 | 0.098 | 0.310 | 0.182 |
| I1 | I | 1150 | 2 | 0 | 0.017 †† | 0.420 | 0.0019 | 0.237 | 0.183 *** | 0.181 |
| I2 | I | 1200 | 2 | 0 | 0.017 †† | 0.420 | 0.0019 | 0.150 | 0.270 | 0.181 |
| J1 | J | 1150 | 2 | 0 | 0.011 †† | 0.418 | 0.0020 | 0.233 | 0.185 *** | 0.181 |
| J2 | J | 1200 | 2 | 0 | 0.011 †† | 0.418 | 0.0020 | 0.151 | 0.267 | 0.181 |
| K1 | K * | 1150 | 2 | 0 | 0.022 | 0.388 * | 0.0021 | 0.220 | 0.168 *,**,*** | 0.181 |
| K2 | K * | 1200 | 2 | 0 | 0.022 | 0.388 * | 0.0021 | 0.145 | 0.243 | 0.181 |
| L1 | L * | 1150 | 2 | 0 | 0.039 †† | 0.662 * | 0.0053 | 0.280 | 0.382 | 0.174 |
| L2 | L * | 1200 | 2 | 0 | 0.039 †† | 0.662 * | 0.0053 | 0.180 | 0.482 *,**,*** | 0.174 |
| M1 | M * | 1150 | 2 | 0 | 0.038 | 0.523 | 0.0062 * | 0.252 | 0.271 | 0.173 |
| M2 | M * | 1200 | 2 | 0 | 0.038 | 0.523 | 0.0062 * | 0.160 | 0.363 | 0.173 |
| N1 | N | 1150 | 2 | 0 | 0.014 †† | 0.412 | 0.0036 | 0.232 | 0.180 *** | 0.178 |
| N2 | N | 1200 | 2 | 0 | 0.014 †† | 0.412 | 0.0036 | 0.150 | 0.262 | 0.178 |
| O1 | O | 1150 | 2 | 0 | 0.032 | 0.460 | 0.0055 | 0.243 | 0.217 | 0.174 |
| O2 | O | 1200 | 2 | 0 | 0.032 | 0.460 | 0.0055 | 0.154 | 0.306 | 0.174 |
| U1 | U | 1150 | 2 | 0 | 0.005 † | 0.552 | 0.0038 | 0.256 | 0.296 | 0.177 |
| P1 | P * | 1150 | 2 | 0 | 0.0004 * | 0.412 | 0.0018 | 0.232 | 0.180 **,*** | 0.181 |
| P2 | P * | 1200 | 2 | 0 | 0.0004 * | 0.412 | 0.0018 | 0.149 | 0.263 | 0.181 |
| Q1 | Q * | 1150 | 2 | 0 | 0.045 * | 0.635 | 0.0058 | 0.277 | 0.358 | 0.173 |
| Q2 | Q * | 1200 | 2 | 0 | 0.045 * | 0.635 | 0.0058 | 0.176 | 0.459 **,*** | 0.173 |
| R1 | R * | 1150 | 2 | 0 | 0.038 | 0.420 | 0.0032 | 0.238 | 0.182 *** | 0.179 |
| S1 | S * | 1150 | 2 | 0 | 0.036 | 0.445 | 0.0041 | 0.240 | 0.205 | 0.177 |
| T1 | T * | 1150 | 2 | 0 | 0.012 †† | 0.410 | 0.0020 | 0.227 | 0.183 *** | 0.181 |
| T2 | T * | 1200 | 2 | 0 | 0.012 †† | 0.410 | 0.0020 | 0.149 | 0.261 | 0.181 |

| Test piece | Right side value of Formula (ii) | Left side value of Formula (iii) | Right side value of Formula (iii) | Creep rupture test: 650° C. 216 MPa | Creep rupture test: 700° C. 147 MPa | Restraint weld cracking test: 8 mm sample | Restraint weld cracking test: 12 mm sample | |
|---|---|---|---|---|---|---|---|---|
| H1 | 0.475 | 0.200 | 0.430 | Good (acceptable) | Good (acceptable) | Good (excellent) | — | Inventive example |
| H2 | 0.475 | 0.200 | 0.430 | Good (excellent) | — | Good (excellent) | — | |
| H3 | 0.475 | 0.200 | 0.430 | Failed | Failed | Good (excellent) | — | Comparative example |
| H4 | 0.475 | 0.200 | 0.430 | Good (excellent) | — | Good (excellent) | — | Inventive example |
| I1 | 0.472 | 0.198 | 0.436 | Good (acceptable) | — | Good (excellent) | — | |
| I2 | 0.472 | 0.198 | 0.436 | Good (excellent) | Good (acceptable) | Good (excellent) | — | |
| J1 | 0.472 | 0.197 | 0.438 | Good (acceptable) | — | Good (excellent) | — | |
| J2 | 0.472 | 0.197 | 0.438 | Good (excellent) | Good (acceptable) | Good (excellent) | — | |
| K1 | 0.472 | 0.198 | 0.433 | Failed | Failed | Good (excellent) | — | Comparative example |
| K2 | 0.472 | 0.198 | 0.433 | Failed | — | Good (excellent) | — | |
| L1 | 0.459 | 0.193 | 0.413 | Good (excellent) | — | Failed | — | |
| L2 | 0.459 | 0.193 | 0.413 | Good (excellent) | — | Failed | Failed | |
| M1 | 0.455 | 0.191 | 0.410 | Good (excellent) | — | Failed | — | |
| M2 | 0.455 | 0.191 | 0.410 | Good (excellent) | — | Failed | Failed | |

TABLE 3-continued

| | | | | | | | | |
|---|---|---|---|---|---|---|---|---|
| N1 | 0.466 | 0.194 | 0.430 | Good (acceptable) | Good (acceptable) | Good (excellent) | — | Inventive example |
| N2 | 0.466 | 0.194 | 0.430 | Good (excellent) | Good (acceptable) | Good (excellent) | — | |
| O1 | 0.458 | 0.192 | 0.415 | Good (excellent) | Good (excellent) | Good (excellent) | — | |
| O2 | 0.458 | 0.192 | 0.415 | Good (excellent) | Good (excellent) | Good (excellent) | Good (excellent) | |
| U1 | 0.465 | 0.193 | 0.433 | Good (excellent) | Good (acceptable) | Good (excellent) | Good (excellent) | |
| P1 | 0.473 | 0.196 | 0.443 | Failed | Failed | Good (excellent) | — | Comparative example |
| P2 | 0.473 | 0.196 | 0.443 | Failed | Failed | Good (excellent) | — | |
| Q1 | 0.457 | 0.192 | 0.409 | Good (excellent) | — | Failed | — | |
| Q2 | 0.457 | 0.192 | 0.409 | Good (excellent) | Good (excellent) | Failed | — | |
| R1 | 0.467 | 0.197 | 0.422 | Good (excellent) | Good (excellent) | Failed | — | |
| S1 | 0.463 | 0.195 | 0.419 | Good (acceptable) | Failed | Good (excellent) | — | |
| T1 | 0.472 | 0.197 | 0.437 | Failed | Failed | Good (excellent) | — | |
| T2 | 0.472 | 0.197 | 0.437 | Failed | — | Good (excellent) | — | |

The mark "*" indicates that a value with the mark fell out of the range specified in the present invention.
The mark "†" indicates that content of P fell out of its preferable range
The mark "††" indicates that content of P fell out of its more preferable range.
The mark "**" indicates that a value with the mark fell out of the range of Formula (ii).
The mark "***" indicates that a value with the mark fell out of the range of Formula (iii).
The underline indicates that an underlined value fell out of its preferable production condition or out of its targeted property value according to the present invention.
$0.170 \leq Nb - Nb_{ER} \leq 0.480$ . . . (i)
$-2B + 0.185 \leq NP - Nb_{ER} \leq -4B + 0.480$ . . . (ii)
$0.08P - 2B + 0.200 \leq Nb - Nb_{ER} \leq -0.4P - 4B + 0.450$ . . . (iii)

From Table 2 and Table 3, it is found that test pieces for which the steel types A to J satisfying chemical components specified in the present invention were used and performed appropriate solution heat treatment, which satisfy the specification according to the present invention in amounts of dissolved Nb as being the middle value of Formula (i) and provide a favorable creep strength and had a sufficient weld crack resistance. In addition, comparison of the test pieces A to H, and O shows that the amount of dissolved Nb satisfying Formula (ii) enables these properties to be provided stably. It is additionally understood that satisfaction of Formula (iii) enables these properties to be provided more stably.

Further, comparison of test pieces D2, F2, I2, J2, N2, O2, U1, P2, and Q2 shows that P is preferably controlled within a predetermined range to provide stable creep strength, and the amount of P is preferably increased to provide high creep strength. On the other hand, it is also understood that excessive containing of P decreases weldability. In addition, comparison of test pieces A1 and A5 to A9 shows that a temperature drop from the temperature of the solution heat treatment up to the start of the cooling is preferably set to 40° C. or less.

In contrast, a test piece H3 had an amount of dissolved Nb that fell below its predetermined range, failing to provide a creep strength as being targeted. Further, a test piece G4 had an amount of dissolved Nb that exceeded its predetermined range, failing to provide a weldability as being targeted.

A test piece K1 for which a symbol K was used had a content of Nb that fell below its predetermined range, and thus its amount of dissolved Nb did not satisfy the specification according to the present invention, failing to provide a creep strength as being targeted. For a test piece K2, the temperature of the solution heat treatment was high compared with K1; therefore, although its amount of dissolved Nb was high compared with K1, its content of Nb did not satisfy the specification according to the present invention, thus failing to provide a creep strength as being targeted.

Test pieces for which symbols L and M were used each had contents of Nb and B that exceeded their respective ranges specified in the present invention; therefore, cracks occurred at their weld heat affected zones due to segregation of Nb and B, failing to provide a weldability as being targeted.

Test pieces for which symbols P and Q were used each had a content of P that fell below or exceeded its range specified in the present invention, thus failing to provide a creep strength and a weldability as being targeted. In addition, test pieces for which symbols R and S were used each had contents of Cr and Ni that exceeded their respective ranges specified in the present invention, thus failing to satisfy one of a creep strength and a weldability as being targeted. Test pieces for which a symbol T was used did not contain Mo, a range of content of which is specified in the present invention, thus failing to satisfy a creep strength as being targeted.

INDUSTRIAL APPLICABILITY

According to the present invention, it is possible to provide an austenitic heat resistant steel having a stable, favorable creep strength and an excellent weld crack resistance in its use at high temperature.

The invention claimed is:

1. An austenitic heat resistant steel comprising
a chemical composition consisting of, in mass %:
C: 0.04 to 0.12%,
Si: 0.01 to 0.30%,
Mn: 0.50 to 1.50%,
P: 0.005 to 0.040%,
S: less than 0.0050%,
Cu: 2.2 to 3.8%,
Ni: 8.0 to 11.0%,
Cr: 17.7 to 19.3%,
Mo: 0.01 to 0.55%,
Nb: 0.400 to 0.650%,
B: 0.0010 to 0.0060%,
N: 0.050 to 0.160%,
Al: 0.025% or less,
O: 0.020% or less,
Co: 0 to 1.00%,
W: 0 to 1.00%,
Ti: 0 to 0.40%,
V: 0 to 0.40%,
Ta: 0 to 0.40%,
Sn: 0 to 0.0300%,
Ca: 0 to 0.0100%, Mg: 0 to 0.0100%, and
REM: 0 to 0.0800%,
with the balance: Fe and impurities, wherein
a difference between a content of Nb and an amount of Nb analyzed as extraction residues satisfies Formula (i) shown below;

$$0.170 \leq Nb\text{-}Nb_{ER} \leq 0.480 \quad (i)$$

where Nb in the formula means the content of Nb (mass %) contained in the steel, and $Nb_{ER}$ means the amount of Nb (mass %) analyzed as extraction residues,
wherein the austenitic heat resistant steel has a rupture time of 1800 hours or more under a condition of 700° C.×147 MPa, and
wherein the austenitic heat resistant steel has a rupture time of 950 hours or more under a condition of 650° C.×216 MPa.

2. The austenitic heat resistant steel according to claim 1, wherein Formula (ii) shown below is satisfied;

$$-2B+0.185 \leq Nb\text{-}Nb_{ER} \leq -4B+0.480 \quad (ii)$$

where symbols of elements in the formula mean the contents (mass %) of the elements contained in the steel, and $Nb_{ER}$ means the amount of Nb (mass %) analyzed as extraction residues.

3. The austenitic heat resistant steel according to claim 2, wherein the chemical composition contains one or more elements selected from, in mass %:
Co: 0.01 to 1.00%,
W: 0.01 to 1.00%,
Ti: 0.01 to 0.40%,
V: 0.01 to 0.40%,
Ta: 0.01 to 0.40%,
Sn: 0.0002 to 0.0300%,
Ca: 0.0002 to 0.0100%,
Mg: 0.0002 to 0.0100%, and
REM: 0.0005 to 0.0800%.

4. The austenitic heat resistant steel according to claim 3, wherein Formula (iii) shown below is satisfied;

$$0.08P-2B+0.200 \leq Nb-Nb_{ER} \leq -0.4P-4B+0.450 \quad (iii)$$

where symbols of elements in the formula mean the contents (mass %) of the elements contained in the steel, and $Nb_{ER}$ means the amount of Nb (mass %) analyzed as extraction residues.

5. The austenitic heat resistant steel according to claim 4, wherein the chemical composition contains, in mass %, P: 0.010 to 0.040%.

6. The austenitic heat resistant steel according to claim 3, wherein the chemical composition contains, in mass %, P: 0.010 to 0.040%.

7. The austenitic heat resistant steel according to claim 2, wherein Formula (iii) shown below is satisfied;

$$0.08P-2B+0.200 \leq Nb-Nb_{ER} \leq -0.4P-4B+0.450 \quad (iii)$$

where symbols of elements in the formula mean the contents (mass %) of the elements contained in the steel, and $Nb_{ER}$ means the amount of Nb (mass %) analyzed as extraction residues.

8. The austenitic heat resistant steel according to claim 7, wherein the chemical composition contains, in mass %, P: 0.010 to 0.040%.

9. The austenitic heat resistant steel according to claim 2, wherein the chemical composition contains, in mass %, P: 0.010 to 0.040%.

10. The austenitic heat resistant steel according to claim 2, wherein the chemical composition contains, in mass %, P: 0.020 to 0.038%.

11. The austenitic heat resistant steel according to claim 1, wherein the chemical composition contains one or more elements selected from, in mass %:
Co: 0.01 to 1.00%,
W: 0.01 to 1.00%,
Ti: 0.01 to 0.40%,
V: 0.01 to 0.40%,
Ta: 0.01 to 0.40%,
Sn: 0.0002 to 0.0300%,
Ca: 0.0002 to 0.0100%,
Mg: 0.0002 to 0.0100%, and
REM: 0.0005 to 0.0800%.

12. The austenitic heat resistant steel according to claim 11, wherein Formula (iii) shown below is satisfied;

$$0.08P-2B+0.200 \leq Nb-Nb_{ER} \leq -0.4P-4B+0.450 \quad (iii)$$

where symbols of elements in the formula mean the contents (mass %) of the elements contained in the steel, and $Nb_{ER}$ means the amount of Nb (mass %) analyzed as extraction residues.

13. The austenitic heat resistant steel according to claim 12, wherein the chemical composition contains, in mass %, P: 0.010 to 0.040%.

14. The austenitic heat resistant steel according to claim 11, wherein the chemical composition contains, in mass %, P: 0.010 to 0.040%.

15. The austenitic heat resistant steel according to claim 11, wherein the chemical composition contains, in mass %, P: 0.020 to 0.038%.

16. The austenitic heat resistant steel according to claim 1, wherein Formula (iii) shown below is satisfied;

$$0.08P-2B+0.200 \leq Nb-Nb_{ER} \leq -0.4P-4B+0.450 \quad (iii)$$

where symbols of elements in the formula mean the contents (mass %) of the elements contained in the steel, and $Nb_{ER}$ means the amount of Nb (mass %) analyzed as extraction residues.

17. The austenitic heat resistant steel according to claim 16, wherein the chemical composition contains, in mass %, P: 0.010 to 0.040%.

18. The austenitic heat resistant steel according to claim 16, wherein the chemical composition contains, in mass %, P: 0.020 to 0.038%.

19. The austenitic heat resistant steel according to claim 1, wherein the chemical composition contains, in mass %, P: 0.010 to 0.040%.

20. The austenitic heat resistant steel according to claim 1, wherein the chemical composition contains, in mass %, P: 0.020 to 0.038%.

* * * * *